US009282868B2

(12) United States Patent
Ehrenberger et al.

(10) Patent No.: US 9,282,868 B2
(45) Date of Patent: Mar. 15, 2016

(54) LOW PROFILE CLEANING DEVICE

(71) Applicants: Edward E. Ehrenberger, Ogden, UT (US); Roger Shurtliff, Clearfield, UT (US); Shawn A. Gordon, Honeyville, UT (US)

(72) Inventors: Edward E. Ehrenberger, Ogden, UT (US); Roger Shurtliff, Clearfield, UT (US); Shawn A. Gordon, Honeyville, UT (US)

(73) Assignee: SHUREDON TECHNOLOGIES, LLC, Ogden, UT (US)

( * ) Notice: Subject to any disclaimer, the term of this patent is extended or adjusted under 35 U.S.C. 154(b) by 454 days.

(21) Appl. No.: 13/627,962

(22) Filed: Sep. 26, 2012

(65) Prior Publication Data

US 2013/0074278 A1 Mar. 28, 2013

Related U.S. Application Data

(60) Provisional application No. 61/539,758, filed on Sep. 27, 2011.

(51) Int. Cl.
*A47L 11/24* (2006.01)
*A47L 11/40* (2006.01)

(52) U.S. Cl.
CPC ..... *A47L 11/4061* (2013.01); *A47L 11/4005* (2013.01); *A47L 11/4036* (2013.01); *A47L 11/4075* (2013.01); *A47L 2201/00* (2013.01)

(58) Field of Classification Search
CPC ..... A47L 11/302; A47L 11/30; E01H 1/02
See application file for complete search history.

(56) References Cited

U.S. PATENT DOCUMENTS

| | | | | |
|---|---|---|---|---|
| 3,277,511 | A | 10/1966 | Little et al. | |
| 3,604,037 | A | 9/1971 | Varner | |
| 4,856,138 | A | 8/1989 | Ingermann et al. | |
| 5,054,150 | A | 10/1991 | Best et al. | |
| 5,063,633 | A * | 11/1991 | Ingermann et al. | 15/320 |
| 5,742,966 | A | 4/1998 | Tono | |
| 7,607,191 | B2 | 10/2009 | Morris et al. | |
| 8,051,528 | B2 * | 11/2011 | Davis et al. | 15/320 |
| 2007/0289086 | A1 | 12/2007 | Davis et al. | |
| 2009/0281661 | A1 | 11/2009 | Dooley et al. | |

FOREIGN PATENT DOCUMENTS

EP 0202175 11/1986

OTHER PUBLICATIONS

U.S. Appl. No. 61/539,758, filed Sep. 27, 2011, Ehrenberger et al.
Duplex 420 Steam Wall to Wall Floor Cleaning Machine., Source: http://www.cleantechuk.com/Duplex_Floor_Cleaning_Machines_148/Buy_a_Duplex_420_Steam_Wall_to_Wall_Floor_Cleaning_Machine_478.aspx, Apr. 25, 2011.
Flipper+., Source: http://www.rmclindia.com/product_details_list_main.php?products_id=1001&subcat=1, Apr. 25, 2011.

(Continued)

*Primary Examiner* — Shay Karls
(74) *Attorney, Agent, or Firm* — Workman Nydegger

(57) ABSTRACT

A low profile cleaning device is disclosed. The device has a low profile or height and can clean beneath structures that have a low clearance relative to the floor. The device includes sweeps mounted on a frame. As the device moves in a sweeping direction, the sweeps sweep or clean the floor. Trash or other debris collected by the device can be removed from hard to reach areas.

27 Claims, 15 Drawing Sheets

(56) References Cited

OTHER PUBLICATIONS

Floor Cordless Sweeper., http://www.sz-wholesaler.com/p/356/380-1/floor-cordless-sweeper-50865.html, Apr. 25, 2011.

Mint Cleaner., Source: http://mintcleaner.com/features/, Apr. 25, 2011.

* cited by examiner

LOW PROFILE CLEANING DEVICE

CROSS-REFERENCE TO RELATED APPLICATIONS

This application claims priority to U.S. Provisional Application Ser. No. 61/539,758, filed Sep. 27, 2011, which is hereby incorporated by reference in its entirety.

BACKGROUND

Background And Relevant Art

Cleaning services are required in almost every building. The ability to keep a building (or any given area) clean contributes not only to cleanliness, but also to safety. Removing trash, dirt and other debris is therefore scheduled with regularity. However, there are many situations where the ability to clean is hampered by the environment. Many buildings (e.g., a warehouse) include a significant amount of storage space. Many types of shelving or storage area designs, unfortunately, make cleaning difficult. In particular, the structure of the shelving or storage may hinder the ability to properly clean the area underneath the shelving or storage.

Racks are an example of shelving that are difficult to clean under. These racks are often large and deep. Cleaning underneath the racks manually is difficult because a person often cannot see beneath the racks and often cannot reach far enough underneath the racks to clean properly. In fact, the trash, dirt, or other debris ("trash") may simply be pushed further underneath the racks. Over time, the trash accumulates and becomes a source of concern. For example, the accumulated trash may present a fire hazard.

Moving the racks or other shelving or storage is often impractical because the shelves are usually loaded or are simply too big or are mounted in manner that prevents movement. Regardless of the reason, it is simply inconvenient or too costly to rearrange the racks as well as the items stored on the racks in order to clean underneath them.

Further, the racks often have a relatively low clearance from the floor. The low clearance further complicates efforts to clean underneath the racks or similar types of shelving. As a result, there is a need for systems and methods that have the ability to clean in areas that are difficult to access.

BRIEF DESCRIPTION OF THE DRAWINGS

In order to describe the manner in which the at least some of the advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF EMBODIMENTS OF THE INVENTION

Figure 1:
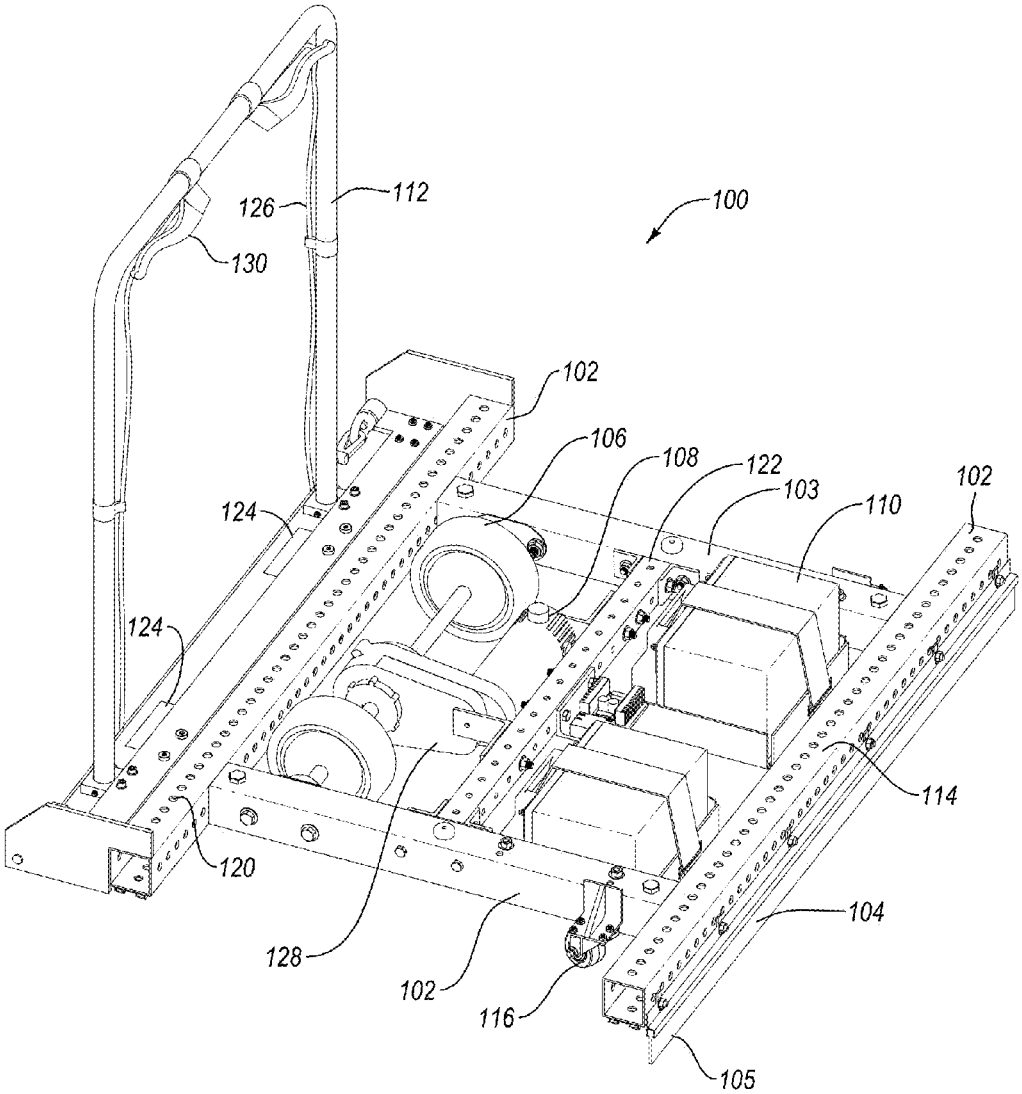
FIG. 1 illustrates an embodiment of a low profile cleaning device and further illustrates an example of a frame of the low profile cleaning device.

Embodiments of the invention relate to a cleaning device. Embodiments of the invention further relate to a low profile cleaning device that can be configured for self propelled operation and that is capable of navigating an area and for cleaning the area. Some embodiments are configured to adapt to and clean around obstacles that may be present in the area being cleaned.

Embodiments of the invention may have a low profile or a low height that enables the cleaning device to maneuver and clean beneath various structures such as racks or shelving. Embodiments also have a relatively larger width. The height and width may be configured such that embodiments can be accommodated in the space available underneath storage such as shelving or racks. Both the width and/or the height may be adjustable either manually or automatically. In addition, the dimensions of the device may be adjusted remotely in some embodiments. The low height enables the device to travel underneath, by way of example only, racks or other objects. The width enables the device to clean a swath of floor underneath the racks or objects.

The device can also be used to clean other areas and is not limited to cleaning underneath an object. Some embodiments include the ability to adjust the width of the device during use. In addition, the device may include jointed or hinged sections that are capable of deflecting (in one or more directions) in order to accommodate obstacles in the path of the device.

Aspects or components of the device may be motorized. The device may include motorized components that allow a width of the device to be changed. The width may be changed (extended or retracted) while cleaning, prior to cleaning, or after cleaning. The ability to change the width of the device may allow the device to be used in environments with changing dimensions or to accommodate situations where the environment may include obstacles.

The device may also be configured to self correct at least in the context of a path being travelled by the device. For example, the device may include guides that are curved or angled. The guides can be mounted on sides of the device such that the direction of the device can be altered. The curved or angled guides may enable the device to adjust to obstacles (e.g., posts of the racks) such that the travel direction remains appropriate. In one example, the guides may accommodate for obstacles that relate to the height direction of the device.

At the same time, embodiments may be configured to have a weight configured for portability and maneuverability. Embodiments of the device may also be modular (e.g., foldable, collapsible, and/or capable of being disassembled or modularized), for example. The modularity of the device enables the device to be stored in less space, assembled in different manners to accommodate different areas, or the like. In addition, embodiments also contemplate a cart (FIG. 12) that may be configured to carry/deliver/orient/store/power the device.

Embodiments of the low profile device disclosed herein generally include a frame including front and rear frame that are connected by side frames. The frame defines an interior that is configured to accommodate various components of the low profile device, including a motor, gears, a battery, or the like. The wheels driven by the motor via the gears are examples of driven wheels. The other wheels that support the device maybe multi-directional wheels such as caster wheels. The device has a profile or height that is configured such that the device can be maneuvered underneath racks or other types of structure.

FIG. 1 illustrates an example of a low profile cleaning device and illustrates an example of a frame 100. The frame 100 includes frame components 102 that are configured in a generally square or rectangular arrangement. The frame components 102 may be hollow such that other components can be movably disposed therein and/or to reduce weight. The frame components 102 may include metal members that are connected, for example, using screws, bolts, welds, pins, or the like. The frame components 102 may include holes 120 or the like that enable other components to be mounted to the frame components 102 as well. The holes 120 enable the size of the frame to be adjusted when connecting, as described in more detail below, side assemblies or other components. The holes 120 also permit the frame to be assembled/disassembled.

The frame components 102 may also have different configurations. For example, side frame components 103 may have a different configuration from front and/or back frame components 114. Side frame components 103 may not include the holes 120, although this is not a requirement. The frame components 102 may be of various shapes. For example, the front and/or back components 114 may be tubular and hollow or flat. The side components 103 may be angle irons in an "L" shape, for example. The frame components 102 may also include an optional crossbar 122 that can be oriented in one or more directions and that facilitates mounting other components to the frame components 102 as illustrated in FIG. 1.

FIG. 1 illustrates a cleaning component 104 (e.g., a broom formed of bristles or a squeegee or other sweep device or component that is capable of moving an object such as trash, dirt, liquid, or other types of debris) that is mounted on the frame 100 and more particularly a front frame component 114 (one of the frame components 102) of the frame 100. The cleaning component 104 is typically mounted to the front frame component 114 in a manner that prevents the cleaning component 104 from interfering with another component sliding within an interior of the front frame component 114. In one example, illustrated in FIG. 1, a bolt that connects the front component 114 with the cleaning component 104 may be flush with an interior surface of the front frame component 114. The cleaning component 104 is typically arranged such that a distal end 105 of the cleaning component 104 is in contact with the floor. As the low profile cleaning device moves, the cleaning component 104 is able to push any trash, dirt, liquid or other debris ("trash").

The frame 100 also includes driving wheels 106 and casters 116. A motor 108 is provided to drive the driving wheels 106 using appropriate gears 128. The casters 116 enable the device to roll and to change direction while being driven. The motor 108 may be powered by a battery 110 or by an electrical source. The driving wheels 106 may be located towards a rear of the frame as illustrated in FIG. 1 or towards a front of the frame 100. The casters 116 are typically placed opposite the driving wheels 106. In addition, the driving wheels 106 may be configured such that power can be directed to a single driving wheel. This may enable the device to be turned, if necessary.

The battery 110 can be mounted to any of the frame components 102. In this example, the driving wheels 106 are mounted to side frame components 103 and/or the optional crossbar 122. Cross bar 122 is attached to side frame components 103. The driving wheels 106 can be connected to the motor 108, for example, by gears 128, such that the motor 108 can rotate the driving wheels 106. The driving wheels 106 can be driven forwards and/or backwards.

In one embodiment, the cleaning device also includes an optional handle 112. The handle 112 enables the cleaning device to be positioned prior to deployment or manually pushed by a person. The handle 112 may also be configured to fold into the frame 100 using hinges 124 or other mechanisms to allow the handle 112 to be folded down (or be detached from the frame 100) while cleaning in order to maintain the low profile of the cleaning device. In other examples, the handle 112 may be removable.

Optional controls 130 may be mounted to the handle 112 and connected to the motor 108 or other component by cord 126. The controls 130 may be a clutch, for example, that enables a user to engage and/or disengage the motor 108. Alternatively, controls 130 may be a break to stop or slow the movement of the frame 100. This embodiment allows a user to control movement of the device. In this example, FIG. 1 shows two controls, but it will be appreciated that different numbers of controls 130 may be used, and in fact in some embodiments may not be used at all.

Figure 2:
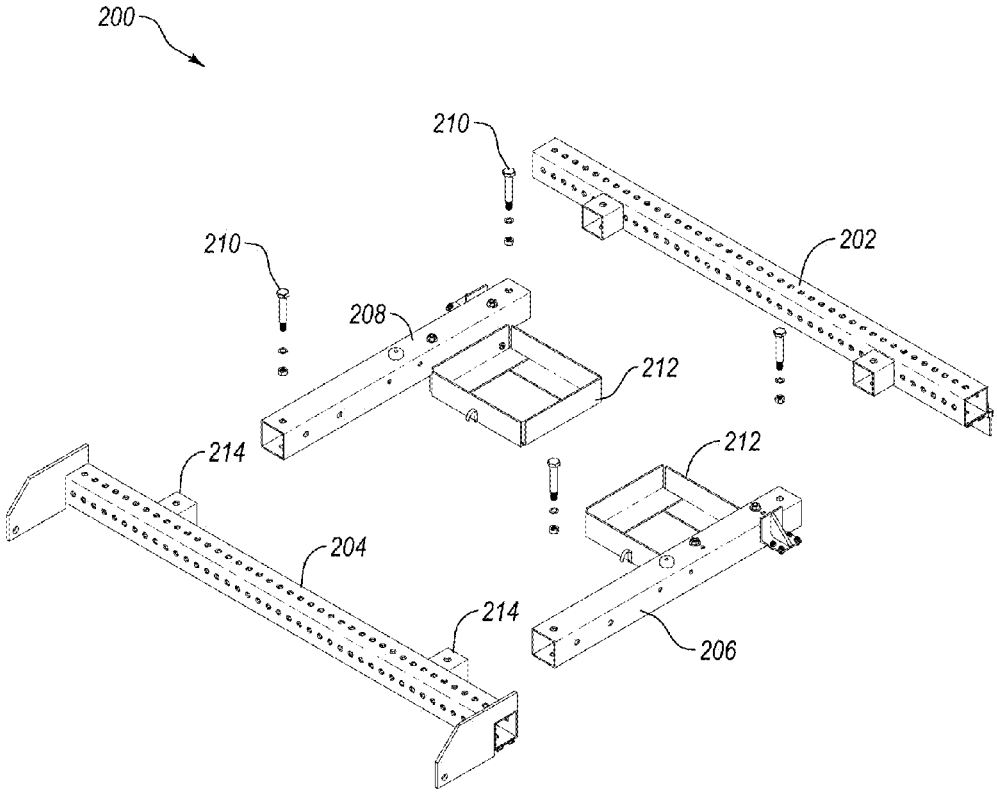
FIG. 2 further illustrates an expanded view of a frame of a low profile cleaning device.

FIG. 2 illustrates an expanded view of a frame 200, which is an example of the frame 100. The frame 200 may include other components as well that are illustrated in other figures. The frame 200 includes a front component 202, a back component 204, and side components 206 and 208. The side components 206 and 208 can be connected with front and back components 202 and 204, respectively, using pins 210 or other attaching mechanisms. In one example, tube brackets 214 may be attached to sides of the front and back components 202 and 204. The side components 206 and 208 are configured to engage the tube brackets 214 and be fixed thereto, for example, using pins 210 or other fixing means. This permits the cleaning apparatus to be assembled and/or disassembled quickly and easily.

A holder 212 (or multiple holders) may be optionally mounted to the side frame components 206 and/or 208 (or to another component). The holder 212 may be configured to accommodate or hold a battery, a motor, cord reel, or other component.

Figure 3B:
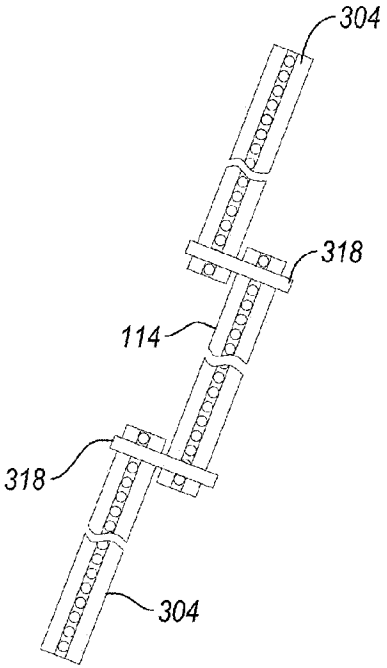
FIG. 3B illustrates another example of frame components of a frame and of a side assembly.
Figure 3A:
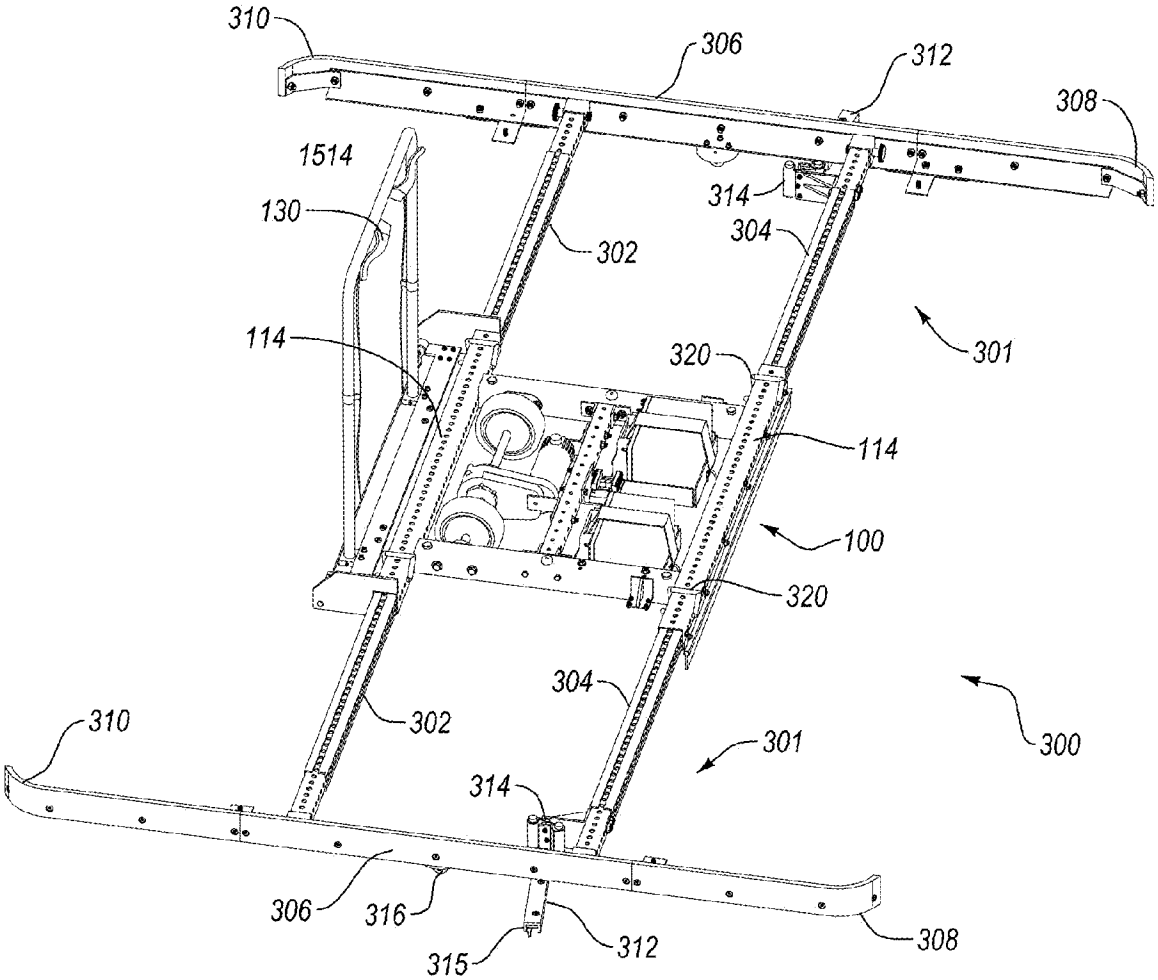
FIG. 3A illustrates an embodiment of a low profile cleaning device with side assemblies connected to a frame of the device.

FIG. 3A illustrates an example of a low profile device 300. The device 300 includes a frame 100 and a pair of optional side assemblies 301, although alternatively the device may be configured with a single side assembly 301. Each side assembly 301 includes arms 302 and 304 that are moveably mounted to the frame 100. In one example, side assembly 301 includes arms 302 and 304 that are telescopically mounted to the frame 100. The arms 302 and 304 can be adapted to slide within the frame components 102 of the frame 100, which may be hollow as previously disclosed. For example, the arms 302 and 304 are slidably or telescopically disposed inside the front and/or back frame components 114. Thus, the overall width of the device 300 can be altered to accommodate different sized areas such as different sized racks. In an alternate example, side assembly 301 may selectively connected to frame 100 as a modular unit that can be easily added or removed to adjust the width of the device.

Pins 320 can be used to quickly adjust the width. The frame components 102 of the frame 100 may include a plurality of holes. The arms 302 and 304 may have similar holes that can be aligned with the holes in the frame components 102. Once the holes are aligned, a pin 320 can be inserted through the aligned holes to set the width of the cleaning device and secure the side assemblies 301 to the frame 100. The pins 320 may pass through the holes in each of the frame components 102 to secure a setting of the side assembly 301 or to set a width of the device 300. It will be appreciated that various other types and configurations of attaching mechanisms may be utilized to easily adjust the width of the arms 302 of device 300.

A guide 306 is attached to the other end of the arms 302 and 304 of side assembly 301. The guide 306 may be detachable. Ends 310 and 308 of the guide 306 are typically curved inward towards the frame 100. The curvature of the ends 308 and 310 enables the device 300 to accommodate for deviations in the path being travelled and to keep the device 300 from being stopped or deviated from its path. For example, the curvature of the ends 308 and 310 enables the guide 306 to adjust the position of the device 300 relative to the posts of the racks under which the device 300 travels. If the device 300 deviates and the device 300 encounters a post, the curved ends 308 and 310 may be able to reorient the device 300 and put the device back on a proper course. The length of the guide 306 may also slide against the posts of the racks during use. The guide 306 may have a material disposed on the outer surface to facilitate sliding and to minimize friction. For example, the guide may have a plastic surface disposed on a metal substrate. In one example, a suitable material is bolted or otherwise connected to an angle iron, which serves as the metal substrate. The guide 306 may be elevated relative to the floor such that the guide 306 does not contact the floor.

The guide 306 can be removably attached to the arms 302 and 304. This enables the guides 306 to be replaced as necessary and also allows for disassembly of the device 300. A cleaning component (e.g., a brush) can optionally be mounted to a bottom of the guide 306. In another example, guide 306 may be attached to frame component 102 of frame 100.

The device 300 may also include an extender 312 mounted to a flexor 314 (e.g., a double hinge). The flexor 314 is mounted to the arm 304 or guide 306 or other component. A cleaning component 315 can be mounted to the extender 312 to extend the cleaning width of the device 300. The flexor 314 is configured to bend or deflect in one or more directions and then return to an original position. For example, the extender 312 may encounter a post as the device moves forward. The flexor 314 allows the extender 312 to deflect such that the device 300 can pass the post and still clean in an area around the post. Once the device is past the post, the flexor 314 returns the extender 312 to its original position. The flexor 314 can be configured to deflect in one direction or two directions (e.g. a double hinge). The guide 306 may also include a support 316 than may roll or slide on the floor and that supports the guide 306. The support 316 may be a hard plastic coaster or a caster wheel. Alternatively, the guide 306 is supported only by the arms 302 and 304.

FIG. 3B illustrates another example of the frame components. In FIG. 3B, the arms 302 and 304 of side assemblies 301 are mounted next to the front frame component 202 in this example. The arms 302 and 304 may be connected to the front frame component 114 of frame 100 by a bracket 318. It will be appreciated that various other types of arrangements and/or connecting methods may be used. More specifically, the arms 302 and 304 can be moveably connected to the frame 100 and/or the front frame component 114 by the brackets 318. In addition, bracket 318 may be configured such that the arms 302 and 304 can slide within the bracket 318 to adjust the width of the device.

Figure 4A:
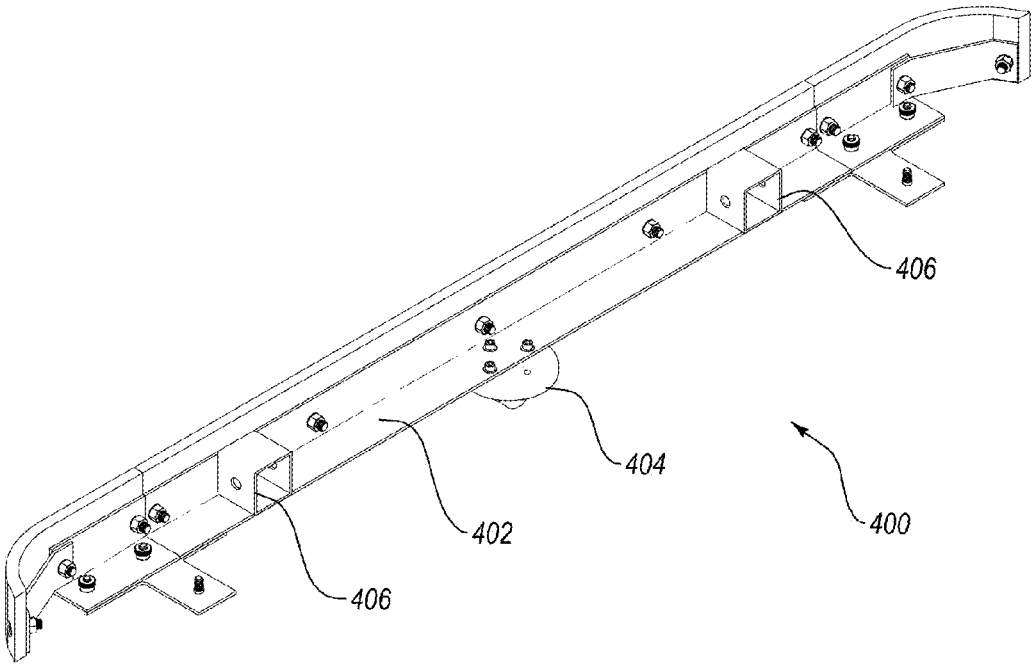
FIGS. 4A and 4B depict illustrative examples of guides that can be connected to the side assemblies or to the frame of a low profile cleaning device.

FIG. 4A illustrates a guide 400, which is an example of the guide 306. The guide 400 includes a brace 402, such as an angled iron. The brace 402 may be configured to provide strength to the guide 400. Tube brackets 406 are mounted on the brace 402 and are configured to attach the guide 400 to the side assembly 301 and more specifically to the arms 302 and 304. Alternatively, the guide 400 can be mounted directly to the frame 100 in a similar manner. Pins or other attaching mechanisms can be used to secure the guide 400. The pins can be inserted horizontally or vertically and the holes in the arms or brackets can be configured accordingly.

The guide 400 may also be provided with a guide support 404. The guide support 404 is configured to rest on a floor during operation of the device 300. The guide support 404 may be a solid piece of plastic, a caster wheel, or the like. The guide support 404 may also be configured such that no part extends past an exterior side of the guide 400. Thus, the guide support 404 does not interfere with movement of the device as guided by the guides 400. The guide 400 may also be configured to have other shapes.

Figure 4B:
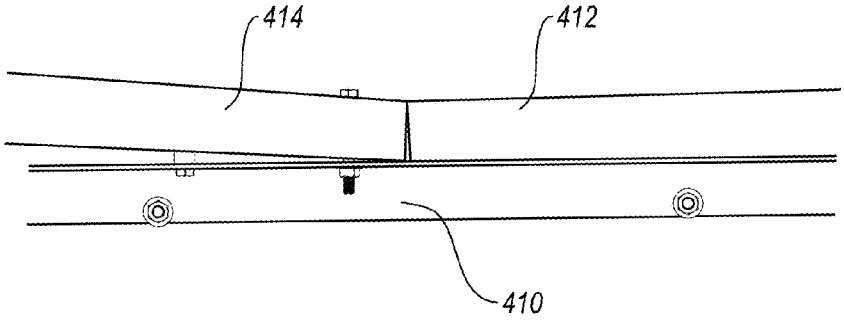

FIG. 4B illustrates another configuration where a guide 410 includes a first portion 412 and a second portion 414. The first portion 412 and the second portion 414 may be angled such that the guide 410 can position the device 300 underneath the stacks while still preventing the guide 410 from catching on a post or otherwise interfering with the maneuverability of the device 300.

Figure 5A:
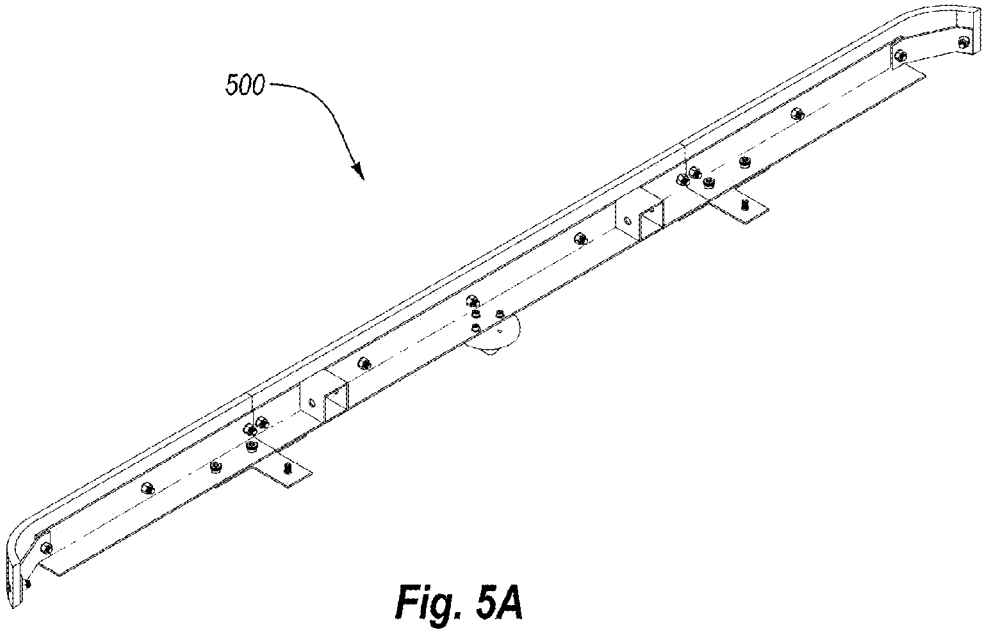
FIGS. 5A and 5B illustrate another embodiment of a guide configured to be removably connected to a side assembly or directly to the frame of the low profile cleaning device.
Figure 5B:
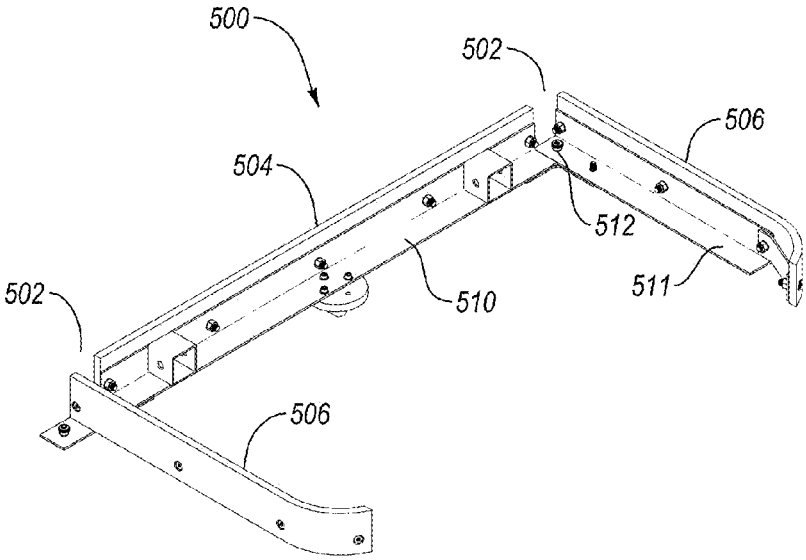

FIGS. 5A and 5B illustrate an example of a guide 500 in an expanded position and a folded position. The guide 500 is an example of the guide 306. The guide 500 includes a middle portion 504 and a pair of end portions 506. A joint 502 removably connects the middle portion 504 with the end portions 506 of guide 500. Guide 500 may also include brace 510. Attached thereto the brace 510 may also include a middle portion 509 that joins with end portions 511 of the brace at a connection 512. In addition, the end portions 506 of guide 500 (and corresponding brace portions, if any) can be secured at an angled position relative to the middle portion 504 during operation. This may ensure that the device is able to navigate an area.

Figure 6A:
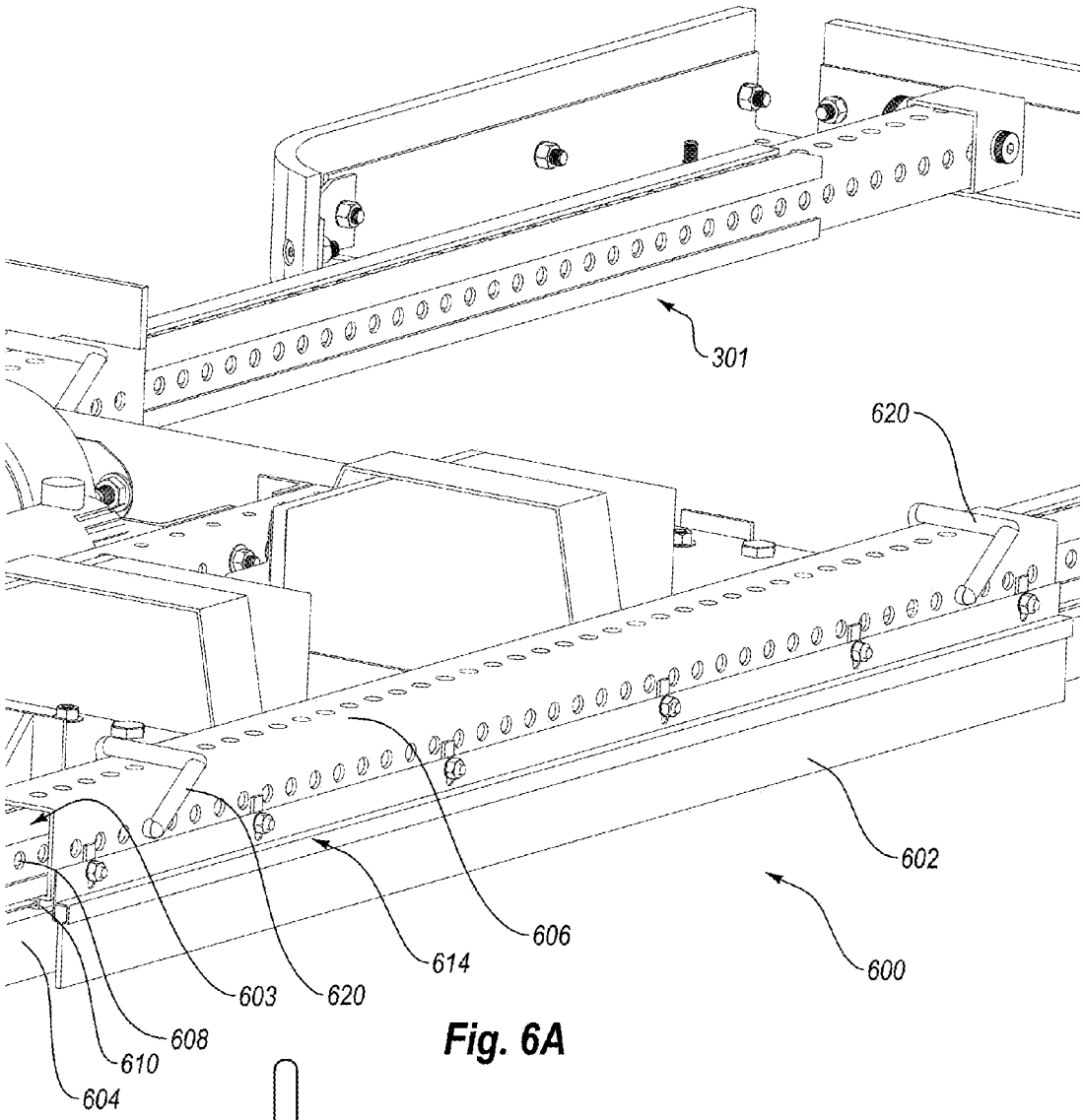
FIG. 6A illustrates an example of a front sweep mounted on one example of the low profile cleaning device.

FIG. 6A illustrates an example of a cleaning component 600, which is an example of the cleaning component 104. The cleaning component 600 includes a sweep 602. The sweep 602 is mounted in a sweep mount 614. In one example, the sweep 602 can be slidably removed from the sweep mount 614 in a direction that intersects a sweeping direction. This enables the sweep 602 to be replaced as necessary when worn or replace with a different type of sweep (e.g., a squeegee for a brush or vice versa). In addition, this enables the low profile cleaning device to operate in different environments and accommodate different cleaning requirements. A squeegee, for example, may enable liquid spills to be collected. In this case, the squeegee may be formed such that the spilled liquid can be retained and/or pushed to a collection point. The sweep 602 can also be curved. This ensures that debris or liquid is funneled toward a center of the device. The curvature can be accomplished, by way of example, using a sweep mount 614 that is curved or by a frame component 606 that is curved. The sweep mount 614 may extend further away from the frame component 606 at ends of the sweep mount 614 than at a center thereof.

Figure 6B:
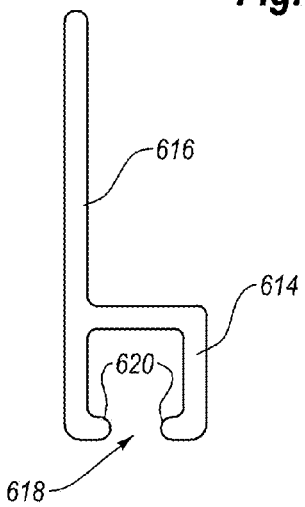
FIGS. 6B-6D illustrates other examples of structure for mounting a front cleaning component or sweep on the low profile cleaning device.

The sweep mount 614 may be mounted to the frame component 606 of the device, for example by bolts or screws. In one example shown in FIG. 6B, the sweep mount 614 includes an elongated potion 616 configured to connect to the frame component 606 (FIG. 6A). As shown in FIG. 6B, the sweep mount 614 may also include a holding portion 618 configured to receive the sweep 602 (FIG. 6A). Edges 620 of FIG. 6B included in the holding portion 618 may be configured to retain the sweep 602 in the sweep mount 614. The top of the sweep 602 may be sized and configured to be removably inserted into the holding portion 618 of sweep mount 614.

Figure 6C:
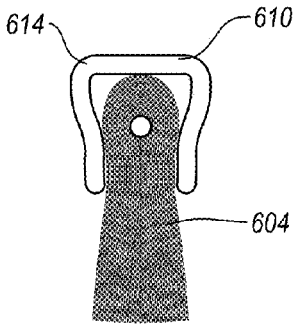

An alternative holding portion 610, such as that depicted in FIG. 6C, may be configured to retain the sweep 604 by pressure and/or friction. Both examples of the holding portion may be configured to hold the sweep 602 or 604 from excessive movement in lateral directions and relative to the floor.

FIG. 6A further illustrates a second cleaning component 603, which includes sweep 604 and is similar to the sweep 602. The sweep 604 disposed in holding portion 610 is mounted to a telescoping arm 608 of the side assembly 301. Often, the sweep mount 614 with the holding portion 610 is mounted to the sliding frame arm 608 of the side assembly 301. In addition, the frame 606 may have an opening on a bottom side to accommodate the sweep 604 with or without holding portion 610. In another example, the holding portion 610 may be directly mounted to an underside of the frame component 606 and/or or arm 608 and may not include an elongated portion such as elongated portion 616 of FIG. 6B. In another example, an underside of the frame component 606 may be configured to receive the holding portion 610 in a slidable manner.

Returning to FIG. 6A, pins 620 fix the position of the arm 608 relative to the frame component 606 and fix a width of the sweep (including the sweeps 602 and 604). It will be appreciated that different types of pins or other types of connecting devices may be used to set the width of the sweep of the cleaning component(s) and correspondingly the device. In this example, the frame component 608 is slidably disposed inside the frame component 606. In another embodiment, the frame component 608 may be slidably disposed on an outside of the frame component 606. Alternatively, frame component 608 may be fixedly attached to frame component 606.

Figure 6D:
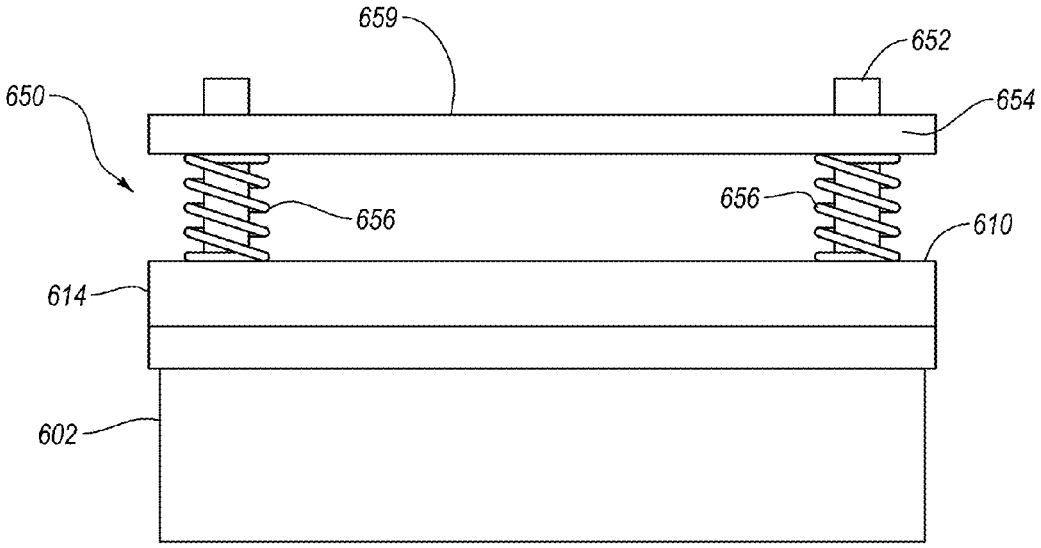
Figure 15:
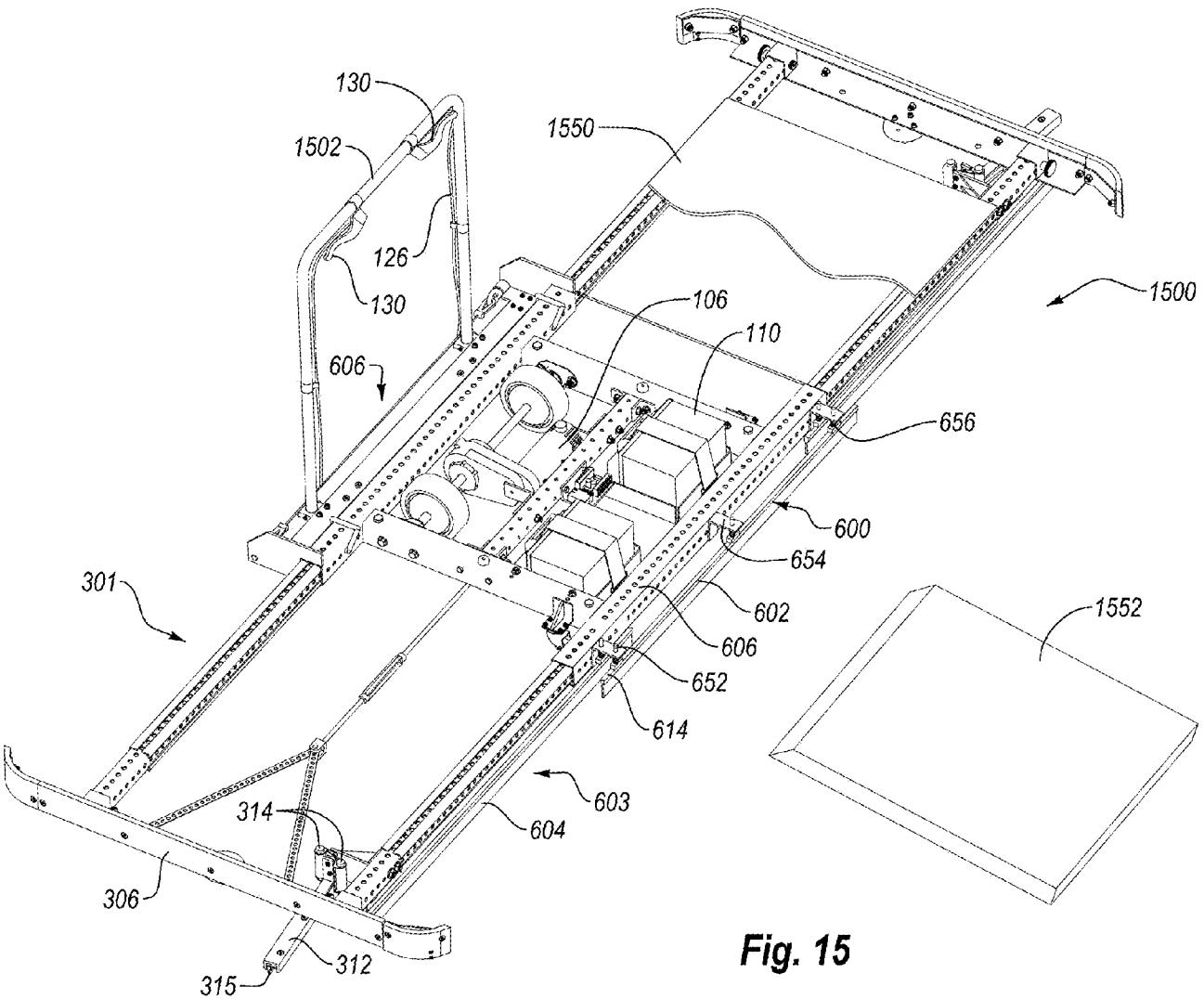

FIGS. 6D and 15 illustrate another example of structure for attaching the cleaning components 600 and/or 603 to the frame 606 and/or a side assembly 301. More specifically, this figure illustrates another example of structure for mounting cleaning component 600 and sweep 602, but is applicable to other cleaning components and their sweeps. In FIG. 6D, the holding portion 610 of sweep mount 614 is connected to a mounting rod 652. A distal end of the rod 652 attaches to the holding portion 610 of mount 614 while the proximal end of rod 652 is inserted into a plate 654 that is attached to the frame component 606. The frame component 606 and the plate 654 are arranged such that an area above the plate 654 is clear (see FIG. 15). This allows the rod 652 to move vertically with respect to the plate 654.

Springs 656 (shown most clearly in FIG. 6D) or other force generating members 656 are disposed around the rods 652, such that the springs push the sweep 602 towards the ground. This structure, however, enables the sweep 602 to move up and down. The sweep is biased down initially. However, allowing the sweep 602 to move vertically allows the device 600 to accommodate obstacles in the path or to accommodate changes in height, or the like. The springs 656 and the rods 652 make the sweep 602 less rigid and allow the sweep 602 to move up and down while sweeping.

In this example, the sweep (e.g., brush, bristles, rubber blade) are biased towards the floor. The bias enables the sweep to more closely follow the floor and helps the operation of the device be more smooth. If the sweep encounters a bump in the floor, for instance, the travel direction may remain unaffected because of the ability of the sweep to adjust vertically while being biased towards the floor.

Figure 7A:
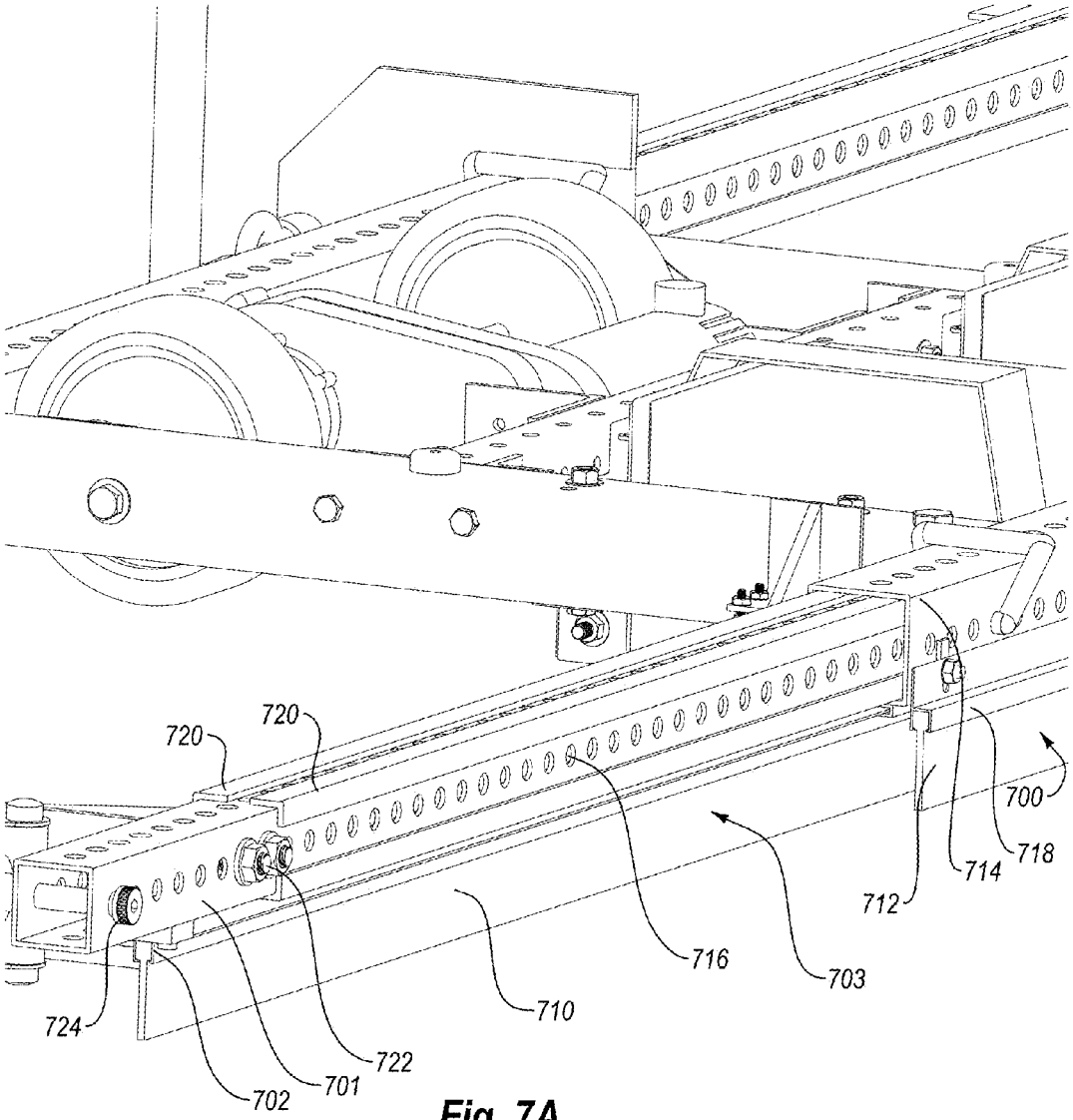
FIG. 7A illustrates an example of a front sweep configured for mounting to a side assembly and an example of the interaction between the front sweep connected to the frame and the front sweep connected to the side assembly.
Figure 7B:
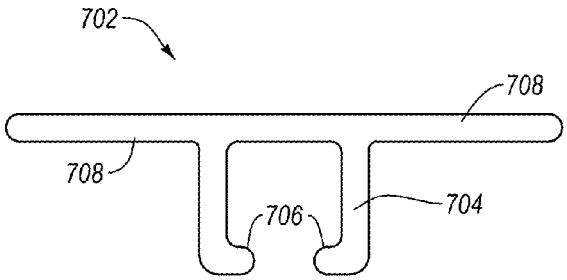
FIG. 7B illustrates another example of structure for mounting a cleaning component or front sweep on the low profile cleaning device.

FIG. 7A illustrates a an example of the adjustability of the cleaning components or sweeps. FIG. 7A illustrates a sweep 712 of first cleaning component 700 attached to a front frame component 714 and a sweep 710 of the second cleaning component 703 that is attached to an arm 701 of side assembly 716. In one example, the arm 701 of the side assembly 716 may include multiple nested frames to accomplish the telescoping effect and adjustability of the width of the device. It will be appreciated that in the alternative, arm 701 of side assembly 716 may be fixed in size. In the example shown in FIG. 7A, the sweep 710 of the second cleaning component 703 attaches to a sweep mount 702 and the sweep 712 of the first cleaning component 700 attaches to a sweep mount 718 as previously described. In this example, shown in FIG. 7B, the sweep mount 702 may include elongated portions 708 that extend laterally and are configured to be mounted to an underside of the arm 701 of the side assembly 716. Edges 706 of sweep mount 702 include the holding portion 704 which may be configured to retain the sweep 710 in the sweep mount 702.

Returning to FIG. 7A, the side assembly 716 may also include angle supports 720. The supports 720 enable the arm 701 of side assembly 716 to slide within front frame component 714 and also provide space for connectors such as bolts and pins that may be necessary for assembly of the device. For example, the supports 720 enable bolts 722 and pin 724 to be used while allowing the arm 701 of side assembly 716 and front frame component 714 to be slidably disposed relative to each other.

The cleaning components or sweeps disclosed herein may include different embodiments for different purposes. For instance, the rigidity of the sweeps can be selected to allow for pushing objects such as boxes, wood, dirt, liquid or other debris. In one example, the front of the device, along with the sweepers, are adjustable to provide multiple levels of coverage and sweeping area. In another example, the front of the device, along with the sweepers, are fixedly attached to a predetermined levels of coverage and sweeping area.

In addition, as depicted in one example shown in FIG. 7A, the first cleaning component 700 attached to frame 714 and the second cleaning component 703 attached to the side assembly 716 are arranged proximal to each other. It will be appreciated that the first and second cleaning components 700 and 703 could be arranged in various other configurations such as side-by-side. While second cleaning component 703 is shown in FIG. 7A as overlapping behind first cleaning component 700, it will be understood that the positions could be reversed. Alternatively, in another example first and second cleaning components could be combined into a single cleaning component of a set size.

Figure 8:
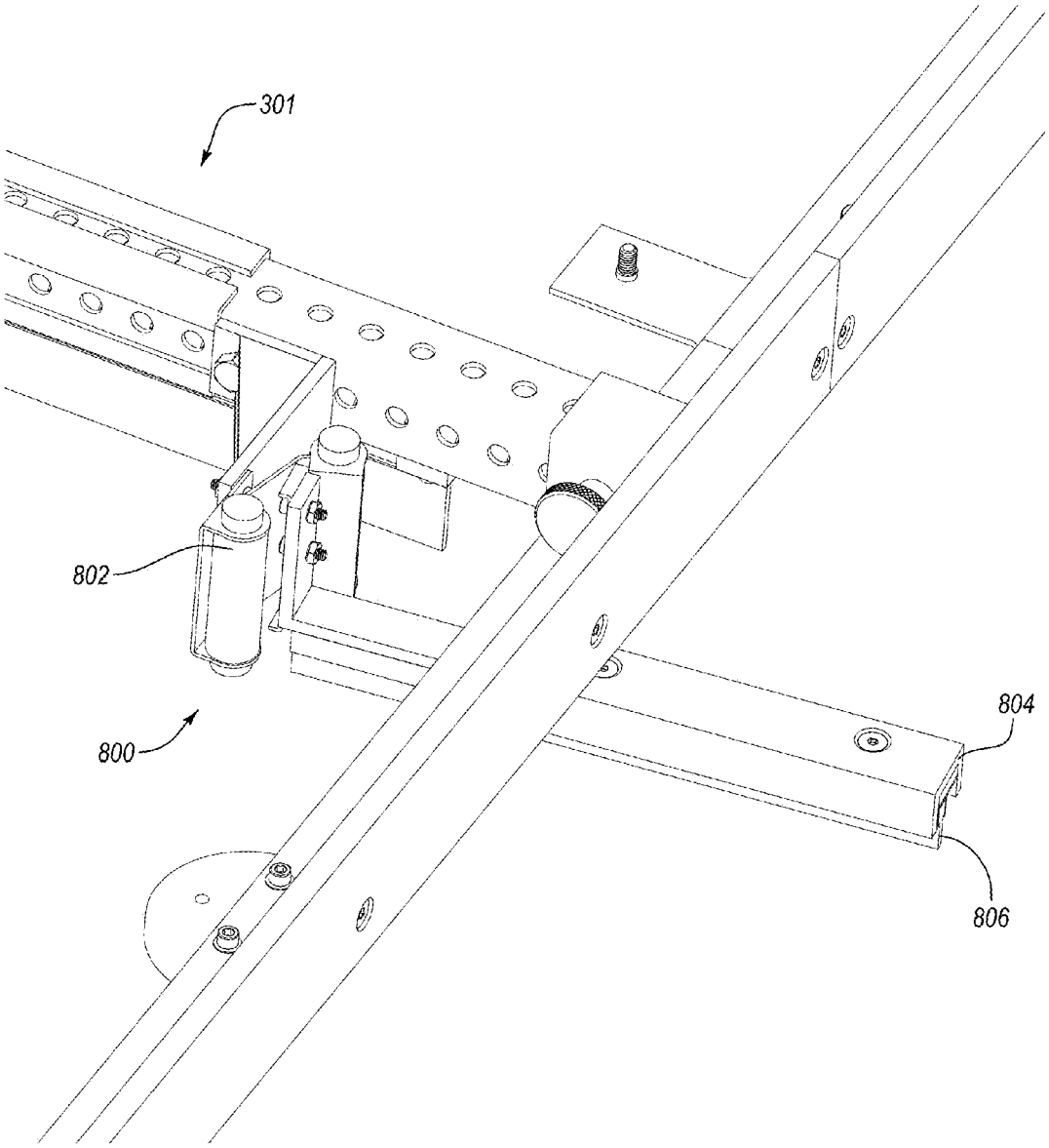
FIG. 8 illustrates an example of a side sweep that connects to the frame or to the side assembly.

FIG. 8 illustrates an example of an extender or a side sweep 800. The side sweep 800 mounts to the side assembly via a double acting hinge 802 in this example. The double acting hinge 802 enables the side sweep 800 to accommodate obstacles whether moving forward or backward. A sweep 806 is mounted in a sweep mount 804, which is attached to the hinge 802. The side sweep 800 extends the sweeping width of the device and enables additional sweeping ability. The side sweep 800 may also be angled, at a home position, relative to the front sweep. This may cause debris being collected to be retained by the device during operation.

Figure 9:
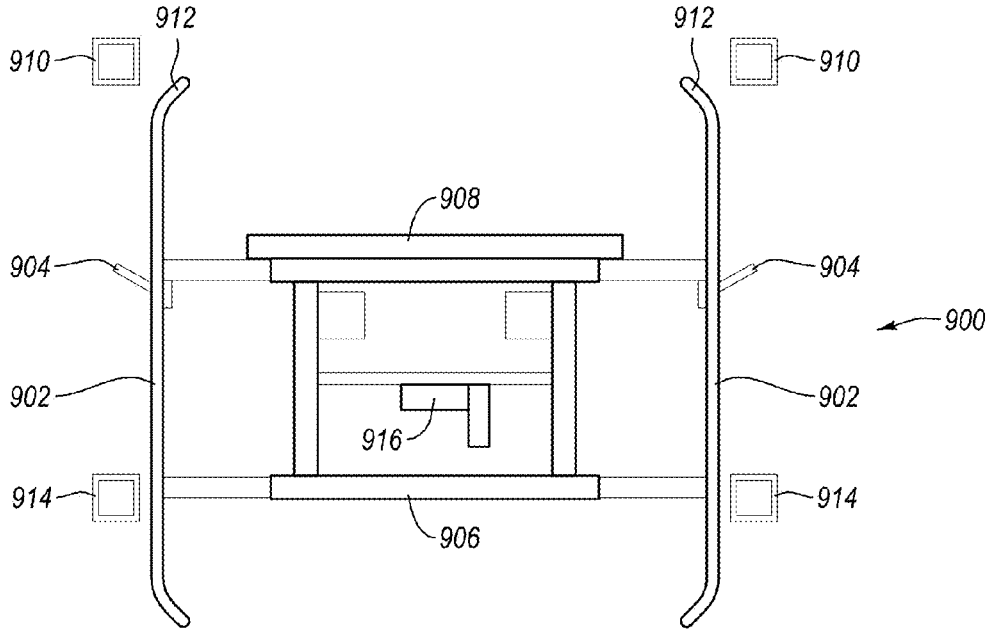
FIG. 9 illustrates a top view of one embodiment of a low profile cleaning device.

FIG. 9 illustrates a top view of an example of a cleaning device 900. FIG. 9 illustrates the ability of the device 900 to navigate underneath racks or underneath other areas. The guides 902 are curved at the ends 912. This enables the device to accommodate for obstacles such as posts 910 (which support the racks). The curved guides 902 enable the device 900 to adjust its path. Sides of the guides 902 may abut posts 914 during operation.

The device 900 includes side sweeps 904 in addition to a front sweep 908 mounted to a frame 906. When the side sweeps 904 hit the posts 910, the hinge enables the side sweeps 904 to bend such that the side sweeps 904 can pass the posts in either direction.

The device 900 may also include a controller 916 that may be configured to automatically control operation of the device 900 or aid in the operation of the device 900. The controller 916 can be mounted separately or can be integrated with other components of the device. The controller 916 may have access to memory or the like as necessary and may be connected to the motor or other components of the device 900. In addition, the device 900 may include sensors at various locations on the device that provide input to the controller 916. For example, the sensors can be used to detect position of the device, the proximity of a wall, or the like. The controller 916 may enable a path of the device 900 to be programmed. As a result of the program, the device 900 will follow a particular path.

For example, the controller may monitor the progress of the device 900. When the device hits a wall or reaches an end of a path, the sensors may detect the change in velocity or may detect the wall by touch. The controller 900 may operate to reverse the direction of the device 900. Alternatively, the device may push debris/trash to a predetermined location such that the debris can be collected by a pass of the device 900 from another direction, as illustrated in FIG. 10.

Figure 10:
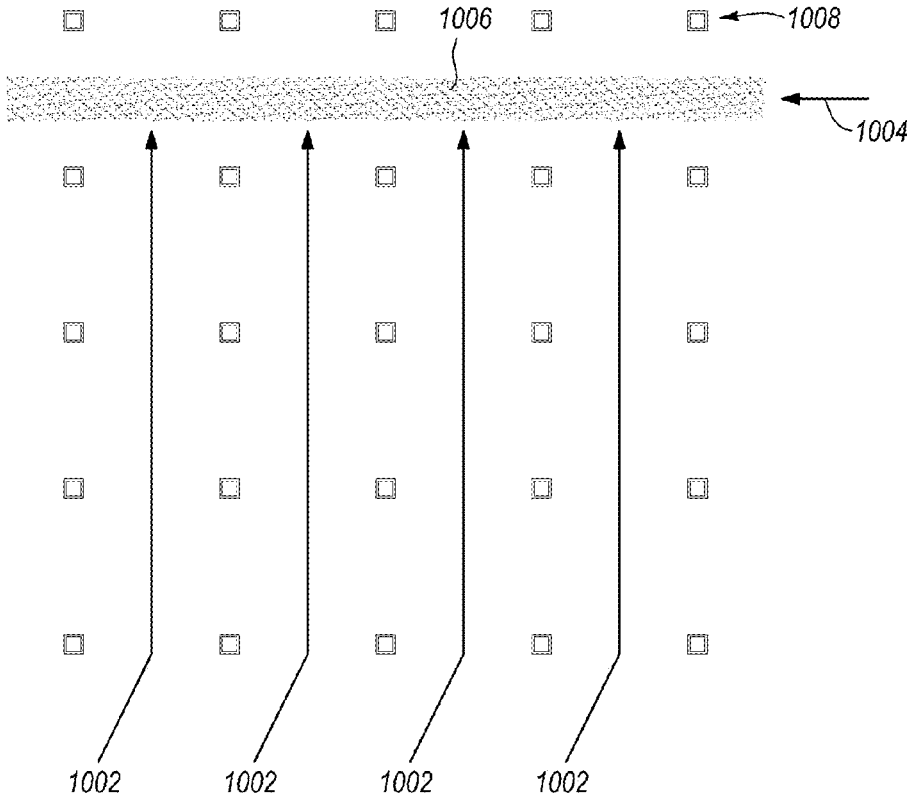
FIG. 10 illustrates an embodiment of an area to be cleaned with a low profile cleaning device and a method of cleaning the area.

For example, as depicted in FIG. 10, the device 900 may traverse the paths 1002 to form a pile 1006 of trash underneath racks 1008. A path 1004 can then be traversed to push the trash out from underneath the racks 1008. The controller 916 can control the positioning of the device 900. In order to accommodate various situations, the side assembly may be configured to be extended automatically during use. In this case, the controller 916 may be able to increase a size of the swath of the device during use. The telescoping side assembly can be automatically extended and/or retracted using an appropriate configuration. The controller 916 may be able to control a speed of the device as well. The device can be controlled remotely, for example, by a wired or wireless connection to a remote that controls movement of the device. The device can also be programmed to follow a particular path as well.

Figure 11:
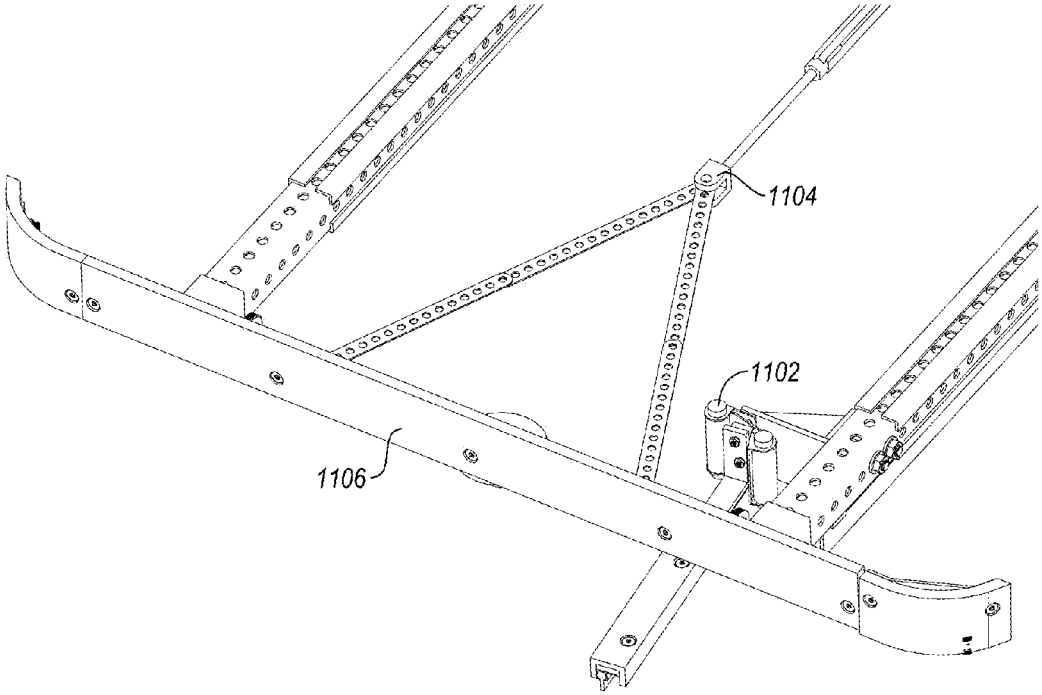
FIGS. 11-16 illustrate additional views of embodiments of the low profile cleaning device or components thereof.

FIG. 11 illustrates a double hinge 1102 that enables the flexor to bend or flex in either direction. A support 1104 is also provided to stabilize the guide 1106 relative to the frame of the device. The support 1104 connects the guide 1106 to the frame and provides additional stability. The support can be adjusted to change a tension in the support 1104.

Figure 12:
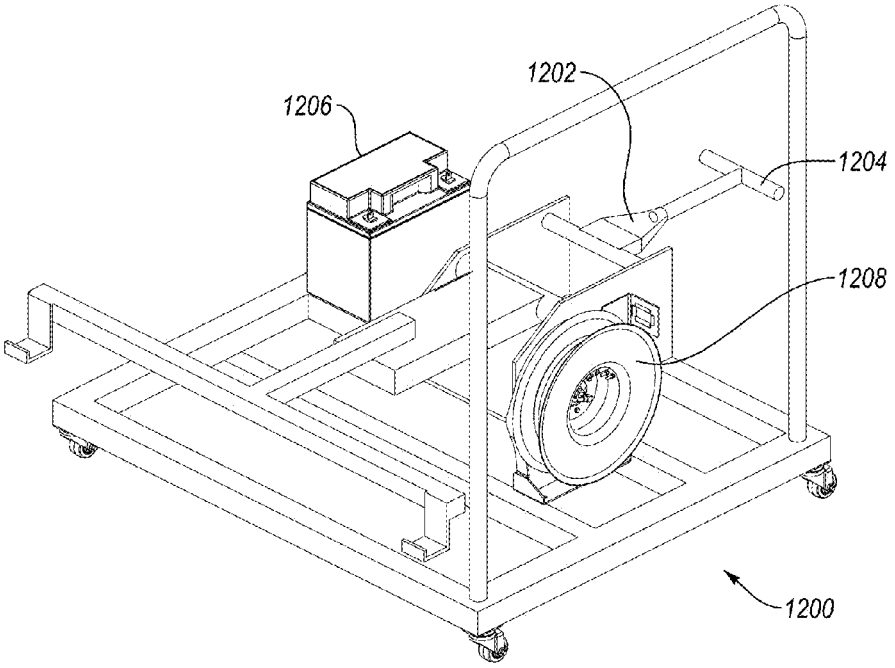

FIG. 12 illustrates an optional cart that is adapted to carry a low profile cleaning device. The cart 1200 may include a delivery mechanism 1202 that can be actuated by a handle 1204 to lower and raise a sweeping device. The cart 1200, for example, can be used to position the device prior to deployment. After the device is positioned, the cart 1200 is used to lower the device to the floor, at which point the device can be operated. The device, as previously stated, may also have wheels that enables additional repositioning if necessary. The cart 1200 may include an optional cord reel 1208 from which power is supplied to the device. The power may alternatively be supplied from a battery 1206 mounted on the cart 1200. In this case, a wired connection may exist to the device.

Figure 13:
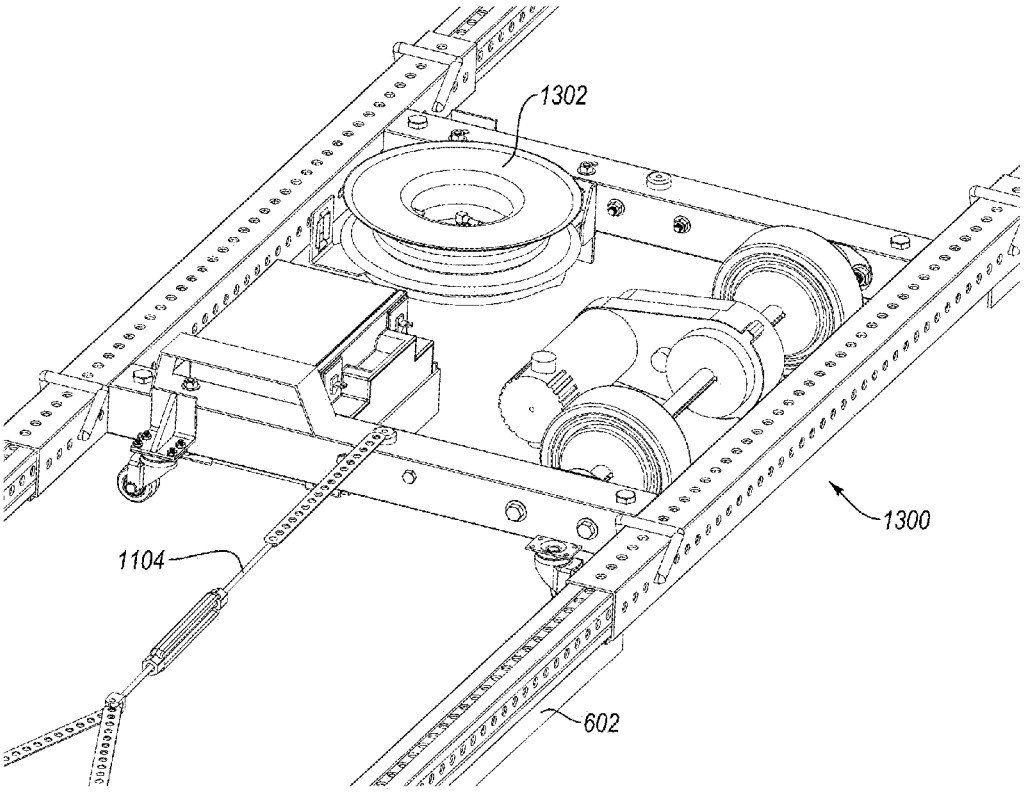

FIG. 13 illustrates a device 1300. In this example, the device 1300 includes an optional cord reel 1302. The cord reel 1302 may enable the device to be plugged in. As the device 1300 moves, the cord reel 1302 enables an electrical cord to be unrolled/rolled so that power is provided to the device 1300. FIG. 13 also illustrates that the support 1104 connects with a frame component. As stated with respect to FIG. 12, the cord reel may be alternatively mounted on a cart.

Figure 14:
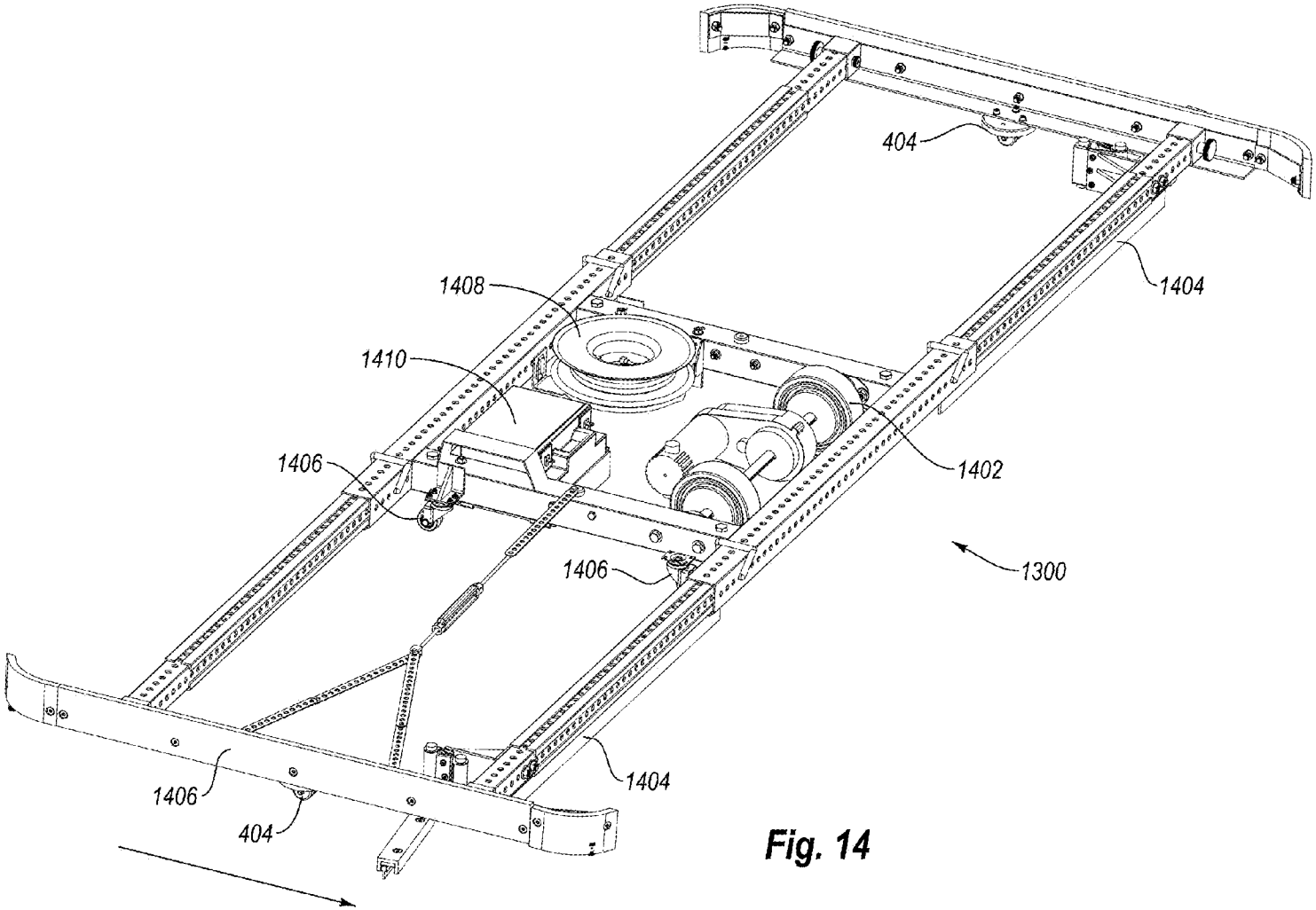

FIG. 14 is a perspective view of the device 1300. In this example, the driving wheels 1402 are at a front of the device. Casters 1416 are mounted at ends of the side assemblies. Casters 1416 may also be located at a rear of the device 1300. The casters 1416 may facilitate turning or reorientation of the device 1300. The casters 1416 also support the frame relative to the floor.

FIG. 15 illustrates a device 1500 that includes a handle 1502. The handle 1502 can be raised/lowered/removed as necessary. In one example, the handle 1502 may facilitate pushing the device 1500. The device 1500 illustrated in FIG. 15 or other figures herein may include covers. More specifically, FIG. 15 illustrates shows one example of optional covers 1550 and 1552 that can be used on device 1500. As shown, the frame may include a removable cover 1552 that hides the components attached to the frame from view when the cover is attached. The cover 1552 may be latched to enable access to an interior of the frame or to the components of the device. It will be appreciated that cover 1552 may be movably connected to the frame in a variety of ways without affecting the function thereof. In another example, cover 1552 could be attached to the frame using hinges. Alternatively, cover 1552 could be slidingly mounted on the frame.

The side assemblies 301 of device 1500 may also include covers 1550 that are similarly configured. Covers 1550 on side assemblies 301 are configured to be removable. In another example, covers 1550 are configured to allow for side assemblies 301 to vary in size thereby adjusting the width of the device. It will also be appreciated that cover 1550 may be movably connected to the side assembly 301 in a variety of ways without affecting the function thereof.

Figure 16:
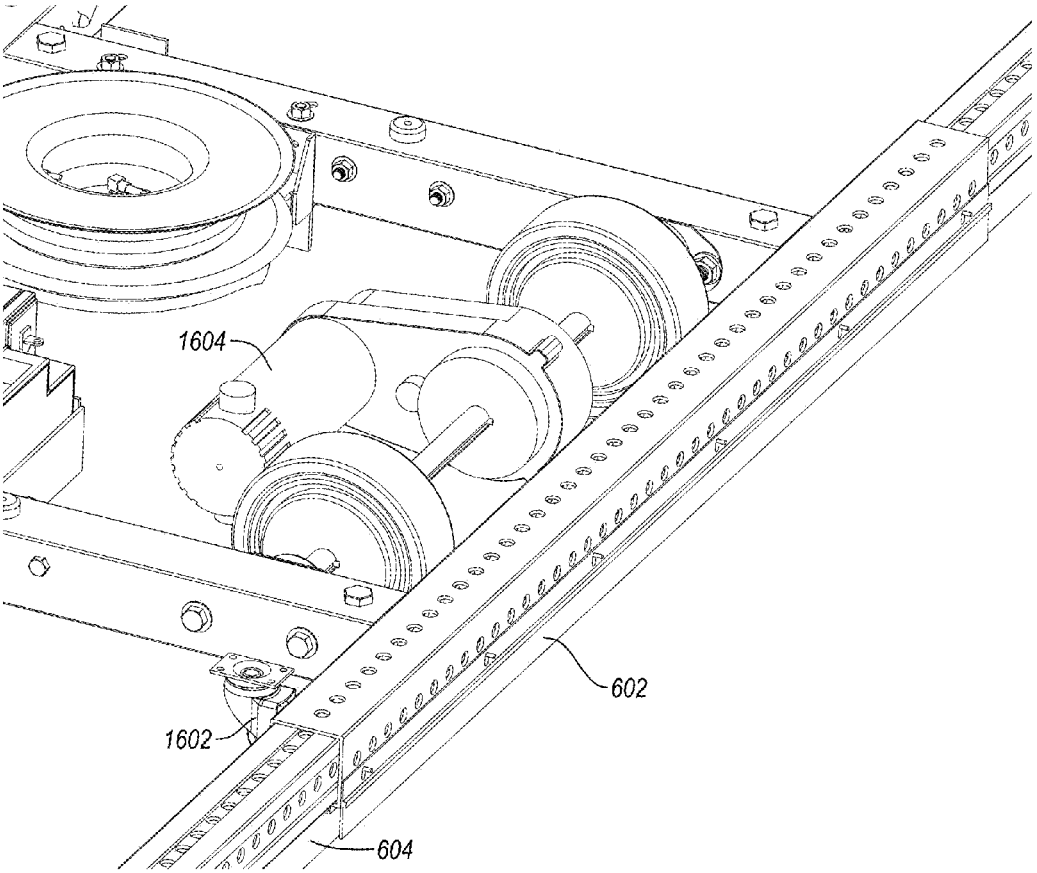

FIG. 16 provides another perspective view illustrating the cord reel and the driving wheels. Power to the motor 1604 can be provided by plug in or by other connection to the cord or to a battery. FIG. 16 also illustrates casters 1602 mounted to a front of the device. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A low profile cleaning device comprising:

a frame having a front frame member and a rear frame member, the front frame member forming the forward-most portion of the frame, wherein ends of the front frame member and ends of the rear frame member are connected by side frame members;

a cleaning component mounted to the front frame member and positioned such that a distal end of the cleaning component is configured to come into contact with a floor, the cleaning component comprises bristles, a brush, or a squeegee; and a motor attached to the frame and configured to drive the low profile cleaning device, wherein the motor and the frame having a low vertical profile which allows the cleaning device to be maneuvered underneath racks.

2. The device of claim 1, further comprising at least one side assembly connected to the frame to extend the cleaning width of the device, the at least one side assembly comprising an elongated second cleaning component mounted to an arm member of the at least one side assembly.

3. The device of claim 2, wherein the at least one side assembly is telescopically connected to the frame.

4. The device of claim 2, wherein the cleaning component includes a sweeper and a holding portion, wherein the sweeper is configured to be removably attached to the holding portion and the holding portion is fixed to the frame.

5. The device of claim 2, wherein the at least one side assembly is connected to an extender, the extender configured to flex when encountering an obstacle.

6. The device of claim 5, wherein the extender is configured to flex at a pivot point in two directions.

7. The device of claim 6, wherein the pivot point includes a double hinge.

8. The device of claim 2, further comprising a guide connected to the at least one side assembly or to the frame, the guide having curved ends.

9. The device of claim 8, wherein the guide extends in a travel direction of the device and is configured to guide travel of the device in the travel direction.

10. The device of claim 1, further comprising:

driven wheels and second wheels, wherein the driven wheels are driven by the motor;

a battery providing power to the motor;

wherein the driven wheels, the second wheels and the battery are attached to the frame.

11. The device of claim 1, wherein the cleaning component is movably mounted to the front frame such that the cleaning component is able to move vertically relative to the front frame.

12. The device of claim 1, further comprising a controller configured to control a travel direction of the device and configured to control the drive of the motor.

13. A low profile cleaning device comprising:

a frame including a front frame member and a rear frame member connected by at least one side frame member, the front frame member forming the forward-most portion of the frame;

components mounted on an interior of the frame, the components including a motor, gears, and a battery that provides power to the motor;

wheels mounted to the frame, wherein the motor drives the wheels using the gears;

a first cleaning component mounted to the front frame member and configured to sweep a floor, wherein the components and the frame having a low vertical profile such that the device is capable of maneuvering underneath racks to sweep the floor underneath the rack.

14. The device of claim 13, further comprising at least one side assembly that is modularly connected with the frame, the at least one side assembly extending generally transverse to the direction of travel of the device, wherein the at least one side assembly includes a second cleaning component that cooperates with the first cleaning component to clean the floor.

15. The device of claim 13, further comprising at least one side assembly that is movably attached to the frame to selectively extend the cleaning width of the device, the at least one side assembly extending generally transverse to the direction of travel of the device, wherein the at least one side assembly includes a second cleaning component that cooperates with the first cleaning component to clean the floor.

16. The device of claim 15, wherein the at least one side assembly includes a guide mounted on a side away from the frame, wherein the guide is configured to control a direction of the device at least when encountering obstacles.

17. The device of claim 16, wherein the guide includes curved ends, wherein the curved ends curve towards the frame.

18. The device of claim 17, wherein a control is mounted on the frame or the handle, wherein operation of the control controls power from the motor to the wheels.

19. The device of claim of claim 15, further comprising a handle, the handle configured to fold into the frame or configured to be removable.

20. The device of claim 15, wherein the at least one side assembly includes an extender, the extender being configured to flex when encountering an obstacle.

21. A low profile cleaning device comprising:

a frame having a front frame member and a rear frame member, wherein the front frame member is connected to the rear frame member by at least one side frame member;

a side assembly mounted to the frame, wherein the side assembly is selectively connected such that the side assembly can be removed or connected according to an area to be cleaned, the side assembly including an arm member;

a first cleaning component mounted to the front frame member and being positioned to at least partially contact a floor;

a second cleaning component mounted to the arm member of the side assembly, the second cleaning component including a distal end configured to at least partially contact the floor, wherein the second cleaning component is arranged such that a portion thereof is proximal a first end of the first cleaning component;

wheels mounted to the frame; and a motor configured to provide power to the wheels in order to drive the device in a sweeping direction.

22. The device of claim 21, wherein the first cleaning component and the second cleaning component include bristles, a brush, or a rubber blade.

23. The device of claim 22, wherein the first cleaning component is mounted to the frame with a spring loaded structure, wherein the spring loaded structure biases the first cleaning component towards the floor while allowing the first cleaning component to move vertically.

24. The device of claim 22, wherein the second cleaning component is attached to said frame such that a first end of the second cleaning component overlaps a first end of the first cleaning component in the sweeping direction.

25. A low profile cleaning device comprising:

a frame having a front frame member and a rear frame member, wherein the front frame member is connected to the rear frame member by at least one side frame member;

a side assembly mounted to the frame, wherein the side assembly including an arm member;

a first cleaning component mounted to the front frame member and being positioned to at least partially contact a floor;

a second cleaning component mounted to the arm member of the side assembly, the second cleaning component including a distal end configured to at least partially contact the floor, wherein the second cleaning component is arranged such that a portion thereof is proximal a first end of the first cleaning component;

wheels mounted to the frame; and a motor configured to provide power to the wheels in order to drive the device in a sweeping direction.

26. A low profile cleaning device comprising:

a frame having a front frame member and a rear frame member, wherein ends of the front frame member and ends of the rear frame member are connected by side frame members;

a cleaning component mounted to the front frame member and positioned such that a distal end of the cleaning component is configured to come into contact with a floor;

a motor configured to drive the low profile cleaning device; and a side assembly connected to the frame, the side assembly comprising a second cleaning component mounted to an arm member of the side assembly, the side assembly being connected to an extender, the extender configured to flex when encountering an obstacle.

27. The device of claim 26, wherein the extender is configured to flex at a pivot point in two directions.

* * * * *